US007204721B2

(12) United States Patent
Lundholm et al.

(10) Patent No.: US 7,204,721 B2
(45) Date of Patent: Apr. 17, 2007

(54) CONNECTOR

(76) Inventors: Christer Lundholm, Box 643, Stockholm (SE) S 101 32; Peter Lundholm, Jakobsbergsvagen 17, Grodinge (SE) S 147 92

( * ) Notice: Subject to any disclaimer, the term of this patent is extended or adjusted under 35 U.S.C. 154(b) by 0 days.

(21) Appl. No.: 10/545,309

(22) PCT Filed: Feb. 12, 2004

(86) PCT No.: PCT/SE2004/000188

§ 371 (c)(1),
(2), (4) Date: Aug. 12, 2005

(87) PCT Pub. No.: WO2004/073117

PCT Pub. Date: Aug. 26, 2004

(65) Prior Publication Data

US 2006/0211290 A1 Sep. 21, 2006

(30) Foreign Application Priority Data

Feb. 14, 2003 (SE) ..... 0300397
Mar. 21, 2003 (SE) ..... 0300772

(51) Int. Cl.
*H01R 24/00* (2006.01)

(52) U.S. Cl. ..... 439/676; 439/352; 439/344

(58) Field of Classification Search ..... 439/344, 439/676, 352–354
See application file for complete search history.

(56) References Cited

U.S. PATENT DOCUMENTS 4,946,401 A * 8/1990 Hori et al. ..... 439/224
5,305,380 A * 4/1994 Hileman et al. ..... 379/445

* cited by examiner

*Primary Examiner*—Khiem Nguyen
(74) *Attorney, Agent, or Firm*—Dowell & Dowell, P.C.

(57) ABSTRACT

The present invention relates to a connector (2), such as a modular connector, comprising a first locking device (4) arranged at the connector body (6), which first locking device is elongated, whose one end (8) is fixedly arranged at the connector body and whose other end (10) is freely arranged at a distance from the connector body and at loading is resilient such that is can be moved (R) against the connector body and intended to be connected in engagement with a female connector intended for the connector, whereby the connector again is disconnectable by spring action of the first locking device inwards, that the connector (2) further comprises a second locking device (12), arranged to the connector body, comprising a movable locking pin (14), whereby the first locking device (4) can be firmly locked by displacement (F) of the locking pin (14) of the second locking device (12).

8 Claims, 1 Drawing Sheet

2
12
24
L
22
4
6
20
18

10
14
8
21

F
26
R
16

CONNECTOR

TECHNICAL FIELD

The present invention relates to a connector, such as a modular connector, preferably intended for a network for telecommunication, data communication, or similar.

BACKGROUND

In the technical world of today, we are building more and more networks for communication. Connectors are used in these networks, so called modular connectors of inter alia the type RJ45, RJ12 or RJ11, which comprises a resilient locking tongue that is arranged to one side of the connector. The connector is intended to be introduced in a corresponding female connector that in general is fixed to an apparatus such as a computer, a modem, a telephone unit or the similar. When the connector is inserted in a female connector intended for a corresponding connector, the locking tongue is connected in engagement with the female connector. When the connector shall be disconnected from the female connector, or introduced for engagement in the female connector, the locking tongue is loaded in direction against the connector body whereby the connector is disconnectable and connectable, respectively, by spring action of the locking tongue inwards.

These female connectors are often positioned such that anybody may remove the connector from the female connector by deliberate, or unconscious action and then disconnect the communication in the network. This may lead to devastating consequences if the improper connector is removed.

In patent document JP 2001118637 a solution is described where a built-in locking in a female connector firmly locks a modular connector by a locking pin from underneath. This does not solve the above mentioned problem, since generally all female connectors already are fixedly mounted in finished apparatuses and the costs for inserting locks in existing apparatuses would be considerable.

In another solution according to publication DE-U1-29819147, the existing resilient locking tongue on a modular connector is used. A plastic cover consisting of two parts is arranged around the connector and prevents the locking tongue from being pushed down. However, this solution provides a permanent locking, complicates the use since the parts of the plastic cover have to be taken apart at connection and disconnection of the modular connector, which makes it difficult for easy handling at assembly/disassembly for a authorized person. Use of blunt tools, for example screwdriver or knife, to separate the parts of the plastic cover may involve risk for damages on the connectors or on the apparatus at which the connector is plugged in.

DESCRIPTION OF THE INVENTION

One object of the present invention is to achieve a connector with locking device that at least partially eliminates those drawbacks that are associated with arrangements according to prior art. Yet an object is to provide a connector with locking device that is designed such that they admits an easy use in connection/disconnection in an apparatus at the same time as it makes it difficult to disassemble/assemble the connector in the apparatus by unauthorized persons and minimizes the risk for damages on apparatuses and connectors at release of the locking of the connector. Yet an object is to achieve a connector with locking device that can be produced to a low cost.

These objects are achieved by a connector, such as a modular connector, according to the present invention as defined in claim 1, comprising a first locking device arranged at the connector body, which first locking device is elongated, whose one end is fixedly arranged at the connector body and whose other end is freely arranged at a distance from the connector body and at loading is resilient such that is can be moved against the connector body and intended to be connected in engagement with a female connector intended for the connector, whereby the connector again is disconnectable by spring action of the first locking device inwards, further that the connector comprises a second locking device, arranged to the connector body, comprising a locking pin, movable in relation to the connector body, whereby the first locking device can be firmly locked by displacement of the locking pin of the second locking device.

An advantage with this solution according to the present invention is that deliberate or unconscious action by unauthorised persons to the traditionally occurring resilient, elongated, locking device of the connector can be prevented by the firmly locking with said second locking device. An authorised person can arrange these lockable connectors in those contacts that are critical and preferably also lock the connector such that no unauthorised or anyone by mistake hardly may break this connection. The solution according to the present invention permits also a cost efficient production. The opening and closing of the second locking device is provided without the need to break apart any parts and minimises the risk for damages to apparatuses and contacts at the release of the locking of the connector.

According to a preferred embodiment of the present invention, the second locking device may be designed such that it only can be opened and closed by means of a specifically shaped tool, such that only an authorised person, having the correct tool, easily can open the locking and remove the connector.

The second locking device of the connector according to the present invention comprises preferably a holding device, fixed to the connector, for the locking pin in which the locking pin can be displaced by a reciprocal motion in an opening in the holding device. The locking pin can be threaded in the holding device whereby the locking pin have to be moved by screwing in the holding device, for example by means of a specifically shaped tool that only fits to the head of the locking pin.

Alternatively, the locking pin can be arranged with snug fit or push fit in an opening in the holding device, whereby the locking pin is permitted to glide by certain or little friction in the holding device. In that respect, a magnet, such as an electromagnet, may suitably control the displacement of the locking pin in the opening in the holding device, that either is arranged at the opening or on a separate tool. According to an alternative embodiment, the displacement of the locking pin can be controlled by means of electronically or pneumatically means of control.

The connector according to the present invention is suitably a modular connector, preferably of the type RJ45, RJ12 or RJ11. The connector is suitably intended for a network for telecommunication, data communication, or similar.

By "locking pin" in this description is meant any elongated device such as a rod, shaft, cotter, casing, screw, etc.

Additional advantages and features according to embodiments of the invention is evident from the claims, and also from the following description of the embodiments.

DESCRIPTION OF THE DRAWINGS

The present invention will now be described more in detail in embodiments, with reference to accompanying drawings, without limiting the interpretation of the invention thereto, where.

DETAILED DESCRIPTION OF EMBODIMENTS

Figures 1A, 1B, 1C, 1D, 1E, 1F:
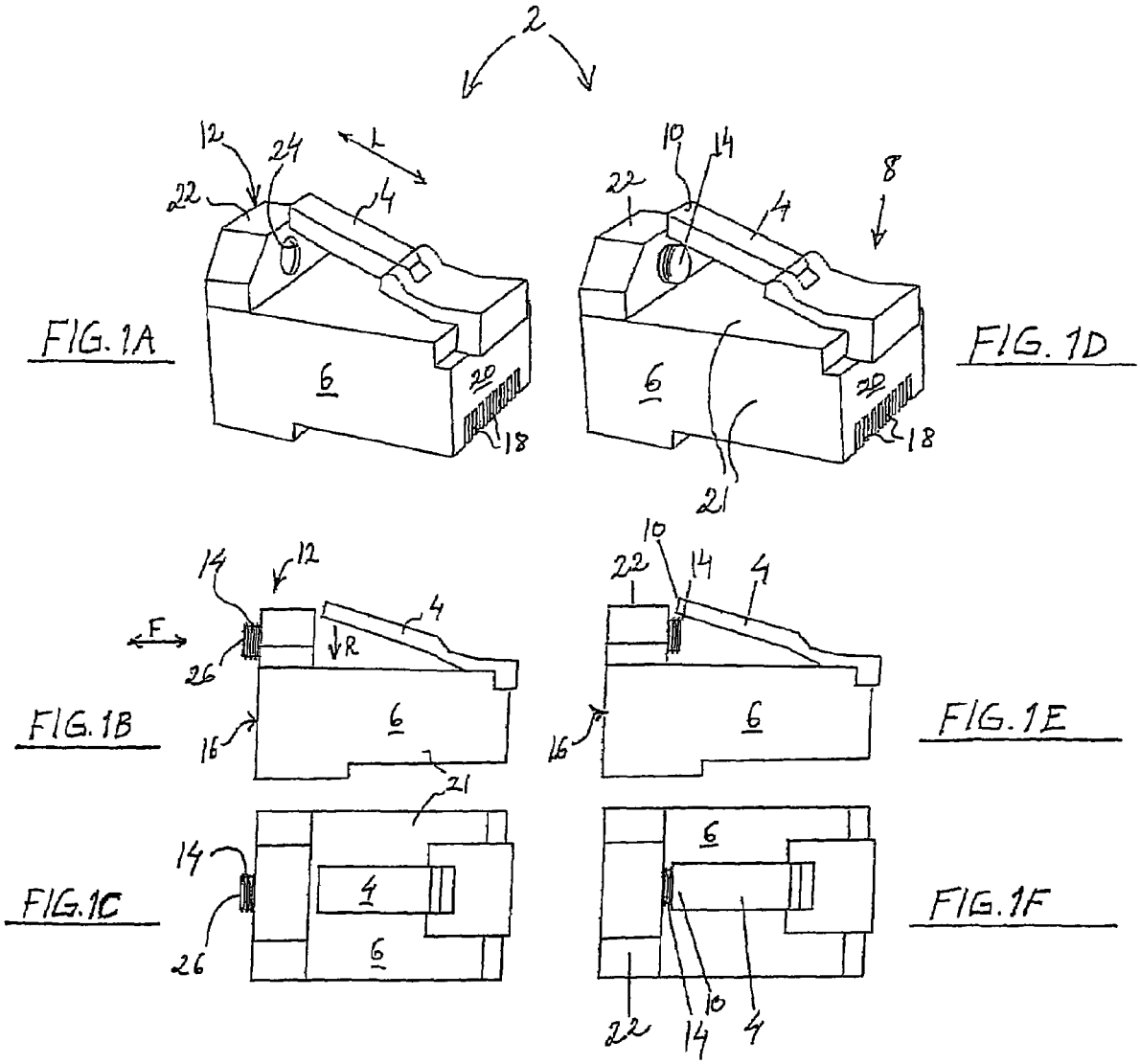
FIG. 1A shows schematically in a perspective view a connector according to the present invention where a locking pin of a second locking device is arranged in a position that permits spring action of a resilient first locking device inwards.
FIG. 1B shows in a view right from the side the connector according to FIG. 1A.
FIG. 1C shows in a view right from above the connector according to FIGS. 1A and 1B.
FIG. 1D shows schematically in a perspective view the connector according to FIG. 1A–C in a position where the locking pin of the second locking device is arranged to prevent spring action of a resilient first locking device inwards.
FIG. 1E shows in a view right from the side the connector and the position of the locking pin according to FIG. 1D.
FIG. 1F shows in a view right from above the connector the position of the locking pin according to FIG. 1F.

A connector 2, in this case a modular connector, is shown in an embodiment of the present invention according to FIG. 1A–F. The connector 2 comprises a first locking device 4 arranged at the connector body 6. The first locking device 4 is elongated in a direction L (see FIG. 1A) and resilient in a direction R (see FIG. 1B). One end 8 of the first locking device 4 is fixedly arranged at the connector body 6 and another end 10 is freely arranged at a distance from the connector body 6. Further, the connector 2 comprises a second locking device 12, arranged to the connector body, comprising a movable locking pin 14. The second locking device 12 is thus integrated with the connector 2. An electric line (not shown), is connected to one short end 16 of the connector 2, which is connected to sheet metal shield 18 (see FIGS. 1A and 1D) at another short side 20 of the connector.

In that position of the locking pin 14, displaced in direction from the connector 2, as shown in FIG. 1A–C, the resilient first locking device 4 can, when pressured, be moved in direction R (se FIG. 1B) against the connector body 6 whereby connection of the connector 2 in engagement with a female connector (not shown) intended for the connector 2 is possible. When the connector is completely inserted in the female connector and the loading on the first locking device is released, the locking device spring back to the position as shown in FIG. 1A–F, and protruding portions at the one end 8 is brought into engagement with a corresponding recess of the female connector. Connector 2 is again disconnectable, from the female connector, by spring action of the first locking device 4 inwards, by movement in direction R against the connector body 6, whereby the connector can be pulled out from the female connector.

As shown in FIG. 1D–F, the first locking device 4 can be locked by displacement, in direction in against connector 2, of the locking pin 14 of the second locking device 12. One end of the locking device 14 is thus placed in a position directly adjacent below the other end 10 of the first locking device. The movement F of the locking pin 14 may suitably be carried out in a direction substantially parallel to a long side 21 of the connector body 6. However, it is possible to arrange that movement of the locking pin can be carried out in other directions, such as parallel to the short sides 20.

According to an embodiment of the present invention, the second locking device of the connector can preferably comprise a holding device 22 for the locking pin 14, fixedly arranged to the connector, as shown in FIG. 1A–F, in which the locking pin can be displaced in an opening 24 in the holding device. By that means, the holding device 22 can be a structure/built-up at the short side 16 of the connector 2 and a part of the long side 21 closest to the short side 16, whereby the structure/built-up has a longitudinal extension in direction against and adjacent to the second end 10 of the first locking device 4. However, it must be clear that the holding device 22 might have other shapes and can be arranged at the connector by alternative ways than what is shown in the embodiment according to FIG. 1A–F.

The locking pin 14 is shown in FIG. 1A–F provided with threads. However, the locking pin may alternatively be arranged with snug fit or push fit in the opening 24 of the holding device.

The protruding end of the locking pin 14 on the outside of the connector is suitably adapted for cooperation with a tool (not shown). For example, the head 26 can be provided with a slot that matches one type of screwdriver, hexagon wrench (Allen key) or similar tool. Alternatively the locking pin may at least partially, preferably in one end that is arranged against the short side 16 of the connector, consist of or be provided with a magnetic material. In that respect, the displacement of the locking pin in the opening in the holding device can be controlled by a magnet (not shown), such as an electromagnet, that either is arranged at the opening or on separate tool.

The invention claimed is:

1. A connector comprising a first locking device attached to a connector body, said first locking device including a first end fixedly attached to said connector body and a second end extending a distance from said connector body, and said first locking device is resilient such that said second end of said first locking device can be moved to an inner position against said connector body for permitting said connector body to be engaged within a female connector adapted to receive said connector body and such that said second end must thereafter be deflected toward said connector body for disconnection of said connector body from the female connector, and a second locking device attached to said connector body including a locking pin movable relative to said connector body and said second end of said first locking device, such that said first locking device can be selectively firmly locked in the outer position by displacement of said locking pin of said second locking device to prevent movement of said second end to inner position.

2. The connector according to claim 1, wherein said second locking device further includes a holding device in which said locking pin can be displaced in an opening in said holding device.

3. The connector according to claim 2, wherein said locking pin is threaded in said opening of said holding device.

4. The connector according to claim 2, wherein said locking pin is arranged with snug fit or push fit in said opening of said holding device.

5. The connector according to claim 1, wherein said locking pin has an end at a short side of said connector body, and said end being of a configuration to cooperate with a tool having a cooperating engaging configuration.

6. The connector according to claim 5, wherein said end of said locking pin is provided with a slot that correspond to a screwdriver, hexagon wrench or similar tool.

7. The connector according to claim 5, wherein said locking pin at least partially consists of a magnetic material.

8. A connector comprising a first locking device attached to a connector body, said first locking device including a first end fixedly attached to said connector body and a second end extending a distance from said connector body, and said first locking device is resilient such that said second end of said first locking device can be moved to an inner position against said connector body for permitting said connector body to be engaged within a female connector adapted to receive said connector body and such that said second end must thereafter be deflected toward said connector body for disconnection of said connector body from the female connector, and a second locking device attached to said connector body including a locking pin movable relative to said connector body and said second end of said first locking device, said second locking device of said connector body further including a holding device fixedly attached to said connector body, and wherein said locking pin can be displaced in a opening in said holding device such that said first locking device can be selectively firmly locked in the outer position by displacement of said locking pin of said second locking device to prevent movement of said second end to inner position.

* * * * *